US011572209B2

(12) United States Patent
Knops

(10) Patent No.: US 11,572,209 B2
(45) Date of Patent: Feb. 7, 2023

(54) DEVICE FOR TRANSPORTING READY-CUT AND FILLED PIECES OF TUBE

(71) Applicant: Teepack Spezialmaschinen GmbH & Co. KG, Meerbusch (DE)

(72) Inventor: Hans Knops, Krefeld (DE)

(73) Assignee: Teepack Spezialmaschinen GmbH & Co. KG, Meerbusch (DE)

( * ) Notice: Subject to any disclaimer, the term of this patent is extended or adjusted under 35 U.S.C. 154(b) by 0 days.

(21) Appl. No.: 17/319,206

(22) Filed: May 13, 2021

(65) Prior Publication Data

US 2021/0354865 A1 Nov. 18, 2021

(30) Foreign Application Priority Data

May 14, 2020 (EP) ..... 20174623

(51) Int. Cl.
*B65B 29/02* (2006.01)
*B65B 29/10* (2006.01)
*B65B 43/50* (2006.01)

(52) U.S. Cl.
CPC ..... *B65B 29/028* (2017.08); *B65B 29/10* (2013.01); *B65B 43/50* (2013.01)

(58) Field of Classification Search
CPC ..... B65B 29/028; B65B 7/02; B65B 43/50; B65B 65/02; B65B 65/00; B65B 29/10
See application file for complete search history.

(56) References Cited

U.S. PATENT DOCUMENTS 2,933,871 A * 4/1960 Brook ..... B65B 11/38 53/234
3,919,829 A * 11/1975 Burford ..... B65B 7/02 53/590

(Continued)

FOREIGN PATENT DOCUMENTS

DE 3806386 C1 3/1989
DE 19532816 B4 4/2004

OTHER PUBLICATIONS

Extended European Search Report for European patent application No. 20174623.7 dated Nov. 11, 2020, 6 pages.

(Continued)

*Primary Examiner* — Thomas M Wittenschlaeger
*Assistant Examiner* — Katie L Gerth
(74) *Attorney, Agent, or Firm* — Dorsey & Whitney LLP

(57) ABSTRACT

The present invention relates to a device for transporting ready-cut and filled pieces of tube. In order to simplify the structural design of a device for transporting ready-cut and filled pieces of tube within a machine for producing double-chamber bags filled with brewable material, having a transport wheel, which has distributed over its circumference a plurality of double-chamber bag forming sets comprising a leading arm and a trailing arm and a profile part provided therebetween and being radially movable and supporting a bottom of a double-chamber bag, and which is rotatably mounted under a cover arranged in the vicinity of the upper vertex of the transport wheel, the present invention proposes that the arms are swivelably mounted eccentrically to the axis of rotation of the transport wheel and that the arms of adjacent double-chamber bag forming sets are swivelably mounted on a common swivel axis.

4 Claims, 4 Drawing Sheets

(56) References Cited

U.S. PATENT DOCUMENTS

| | | | | |
|---|---|---|---|---|
| 3,968,627 | A * | 7/1976 | Seragnoli | B65B 11/34 53/370 |
| 4,258,526 | A * | 3/1981 | Focke | B65B 19/20 53/399 |
| 4,977,728 | A | 12/1990 | Rambold | |
| 2005/0126123 | A1* | 6/2005 | Chase | B65B 7/20 53/504 |
| 2007/0180794 | A1* | 8/2007 | Paunesku | B65B 43/04 53/562 |
| 2007/0209907 | A1* | 9/2007 | Furlotti | B29C 66/53262 198/379 |
| 2009/0056287 | A1* | 3/2009 | Cuypers | B65B 51/14 53/594 |
| 2010/0192524 | A1* | 8/2010 | Rapparini | B65B 31/024 53/284.7 |
| 2010/0281822 | A1* | 11/2010 | Murray | B65B 39/02 53/64 |
| 2011/0232238 | A1* | 9/2011 | May | B65B 43/50 53/235 |
| 2015/0135651 | A1* | 5/2015 | Murray | B65B 43/32 53/384.1 |
| 2015/0251791 | A1* | 9/2015 | Lee | B65B 43/50 53/384.1 |
| 2018/0290838 | A1* | 10/2018 | Bianchi | B65B 43/50 |
| 2019/0217982 | A1* | 7/2019 | Kato | B65B 43/465 |

OTHER PUBLICATIONS

Office Action dated Jul. 5, 2022 in connection with Chinese Patent Application No. 202110521499.0, 16 pages including English translation.

* cited by examiner

DEVICE FOR TRANSPORTING READY-CUT AND FILLED PIECES OF TUBE

CROSS-REFERENCE TO RELATED APPLICATION

This application claims priority to European Patent Application No. 20174623.7, filed May 14, 2020 and entitled "Device for transporting ready-cut and filled pieces of tube", which is hereby incorporated by reference herein in its entirety for all purposes.

FIELD

The present invention relates to a device for transporting ready-cut and filled pieces of tube within a machine for producing double-chamber bags filled with tea.

BACKGROUND

The device, known from DE 38 06 386 C1, has a transport wheel carrying a plurality of double-chamber forming sets distributed on the circumference. Each double-chamber bag forming set comprises a profile part supporting the bottom of the double-chamber bag to be formed and comprises arms provided on both sides for this purpose. In the prior art, when forming the double-chamber bags, previously separated pieces of tube, each containing two portions of tea, are clamped between the arms and a concave contact surface of a cover. These two arms are moved toward each other while a profile part located between the arms holds and guides radially inwardly a central portion of the separated piece of tube. The result of this is a substantially W-shaped configuration of the double-chamber bag, with the two tea portions contained in opposite chambers of the double-chamber bag.

According to the prior art described above, the actuation and mounting of the respective arms is effected via a toggle mechanism, the levers of which are partially swivelably mounted on the transport wheel. There are provided two arms and the movable profile part provided between them for each double-chamber bag forming set of the rotating transport wheel. The arm at the front in the direction of rotation is referred to below as the leading arm, while the arm of the double-chamber bag forming set behind in the direction of rotation is referred to as the trailing arm. The profile part is located between the leading and trailing arms.

DE 195 32 816 B4 also does not deviate from this basic design and merely develops the aforementioned state of the art further in that the arms are designed as elastic springs, so that the separated piece of tube is elastically biased against the contact surface of the cover.

SUMMARY

The actuation and mounting of the arms via a toggle mechanism is complex. It requires a considerable number of components, but nevertheless permits kinematics of the arms together with the profile part in such a way that the formed double-chamber bag can be swivelled with respect to a strictly radial direction in order to position a bag head for subsequent stapling on the transport wheel such that it extends substantially tangentially to the transport wheel.

It is an object of the present invention to constructively simplify the aforementioned device.

To solve this object, the present invention proposes a device having the features of claim 1. In this device, the arms are swivelably mounted eccentrically to the axis of rotation of the transport wheel. Thereby, all arms usually lie on a circular surface, which is arranged concentrically to the axis of rotation of the transport wheel. But even more, the arms of adjacent double-chamber bag forming sets are swivelably mounted on a common axis.

Thus, the trailing arm of a double-chamber forming set that is in front in the direction of rotation is mounted on a common axis with the leading arm of the adjacent double-chamber bag forming set that, in the direction of rotation of the transport wheel, is arranged behind or upstream. If, for example, eight different stations are formed by the transport wheel, each with a double-chamber forming set, then only eight swivel axes need to be formed on the transport wheel itself, each of which allows two of the arms to be swivelled. This significantly reduces the design effort required to manufacture the device.

For further simplification of the design of the apparatus according to the invention, it is proposed in accordance with a preferred embodiment that one of the two arms of one of the double-chamber bag forming sets is driven in a swivelling manner via a cam track, while the other arm of this double-chamber forming set is driven in a swivelling manner in a forcedly coupled manner via a toothing with the one of the arms. In this way, only one of the two arms has to be driven, whereas the other arm, induced by the cam track and due to the toothing, is forced to swivel as a result of the swivelling movement of the one arm.

According to a preferred embodiment of the present invention, one of the two arms of one of the double-chamber forming sets is rotationally fixedly connected to a hollow shaft, in which a drive shaft of the arm of the adjacent double-chamber bag forming set is accommodated. This is based on the consideration that the transport wheel has a certain axial extension and basically accommodates within itself, between two circular discs, the components for supporting and driving the individual double-chamber bag forming sets. Thus, one of the shafts can extend between the two disks and be I swivelably mounted or supported at least on one side, preferably on two sides. The other of the co-axially provided shafts according to the further embodiment can make use of this bearing or support of the one shaft, for example, in that the other shaft is directly supported on the one shaft and is only indirectly supported on the transport wheel via the one shaft.

According to a further preferred embodiment of the present invention, a concave contact surface of the cover is arranged eccentrically to the axis of rotation of the transport wheel, the radial distance of this concave contact surface from the axis of rotation of the transport wheel being greater in a front region of the concave contact surface than in a rear region of the concave contact surface. The front area is the area that is first swept by the leading arm when the respective double-chamber bag forming sets are inserted. The rear section is upstream or behind with respect to the direction of rotation of the transport wheel. The arms can in principle make use of the embodiment according to DE 195 32 816 B4 and accordingly rest under a certain elasticity against the concave contact surface of the cover. The previously discussed embodiment has the effect that, by reducing the radius with increasing movement of the arms under the cover, the swivelling movement of the leading arm towards the center of the double-chamber bag forming set is supported by friction. With increasing rotation of the respective double-chamber bag forming set under the contact surface, the decreasing radial distance accordingly promotes the closing of the double-chamber bag forming set. This allows the swivel drive to the two arms to be provided overall as a weaker configuration. The embodiment can also be essential to the invention in itself. In this context, the invention is defined by the preamble of claim 1 and the features of claim 4.

The front portion of the concave contact surface is the portion, against which the arms abut for clamping the separated piece of tube, while the profile part is lowered in the direction of the axis of rotation of the transport wheel for forming the double-chamber bag. In other words, the front and rear portions according to this embodiment each form clamping surfaces that cooperate with the respective arms upon forming the double-chamber bag by closing the arms of a double-chamber bag forming set. In this case, the front portion is not a conical inlet portion intended to facilitate insertion of the separated piece of tube under the cover.

In other words, a radius in the direction of rotation of the transport wheel immediately in front of an engagement portion of a hold-down device, which forces the severed piece of tube towards the profile part and usually clamps it there, is larger than a radius in the direction of rotation behind this engagement portion.

BRIEF DESCRIPTION OF THE DRAWINGS

Further details and advantages of the present invention will be apparent from the following description of an example of an embodiment in conjunction with the drawing. In the drawing.

DETAILED DESCRIPTION

Figure 1A:
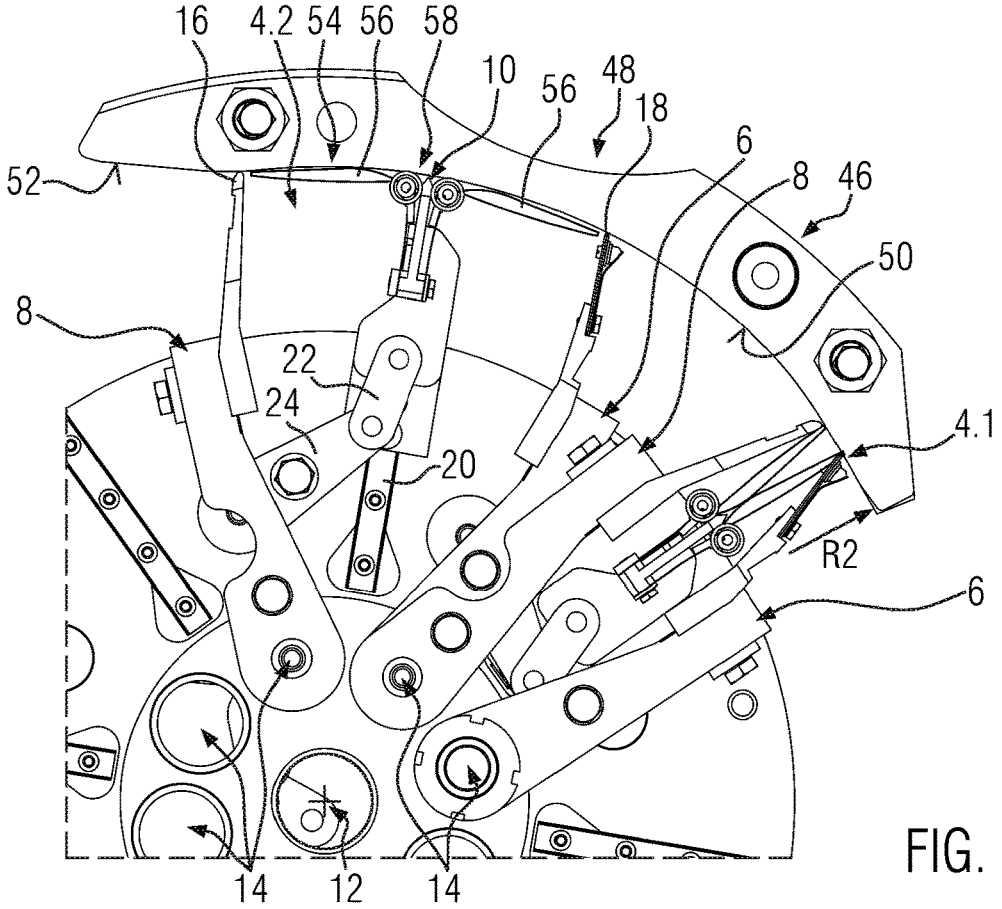
FIGS. 1*a* to 1*e* are side views of a section of a transport wheel with two adjacent double-chamber bag forming sets in different phases.
Figure 1B:
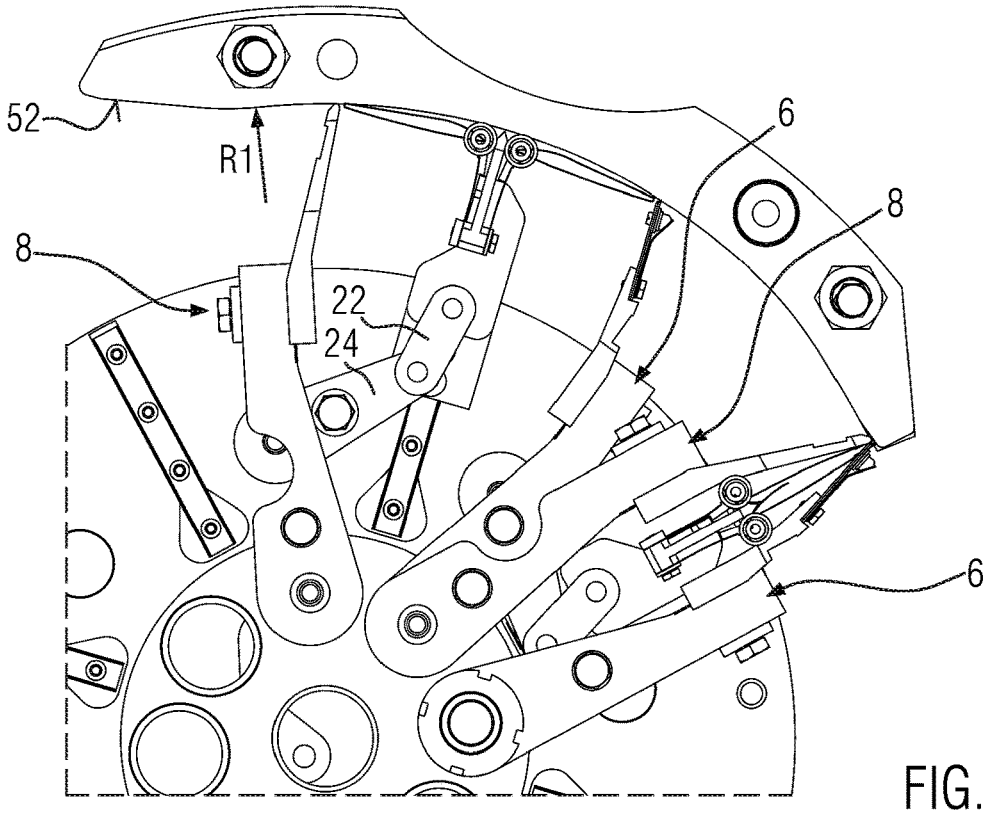

FIGS. 1*a* to 1*e* each show top views of a transport wheel marked with reference sign 2, which in the present case carries and forms eight double-chamber bag forming sets, which are denoted by reference sign 4 and each comprise a leading arm 6 and a trailing arm 8 as well as a profile part or profile part 10 provided therebetween with associated bearing and drive devices. The transport wheel 2 has an axis of rotation denoted by reference 12. Eccentric to this axis of rotation 12 are swivel axes indicated by reference sign 14, about which the arms 6, 8 swivel. The swivel axes 14 lie on a circular surface that has its center in the rotational axis 12.

In FIG. 1*a*, a leading forming set 4 is indicated by reference sign 4.1, whereas a trailing forming set is indicated by reference sign 4.2. The trailing arm 8 of the leading forming set 4.1 is swivelably mounted together with the leading arm 6 of the trailing forming set 4.2 on a common swivel axis 14. For the sake of clarity of the representation, the respective other arm is missing at the level of the leading arm 6 of the leading forming set 4.1 and the trailing arm 58 of the trailing forming set 4.2, respectively.

The arms 6, 8 have plates 16, 18 at their ends, which correspond essentially to the design according to DE 195 32 816 B4.

The profile part 10 is arranged between the leading and trailing arms 6, 8 of a forming set 4 and is mounted on a guide rail 20 so as to be translationally movable. Three lever arms engage on the profile part 10, of which the lever arms 22, 24 are shown in FIG. 1 and all lever arms including the last lever arm 26 are shown in FIG. 2. The lever arms 22, 24 are each connected to each other or to the profile part 10 or the lever arm 26 via floating bearings. The profile part 10 is firmly connected to a holding plate 28, which is guided in the guide rail 20 and on which the lever arm 22 engages in an articulated manner. The profile part 10 has clamping rollers 30 on both sides, which are spring-preloaded against the free end of the profile part 10, as described in principle in DE 195 32 816 B4.

Figure 3:
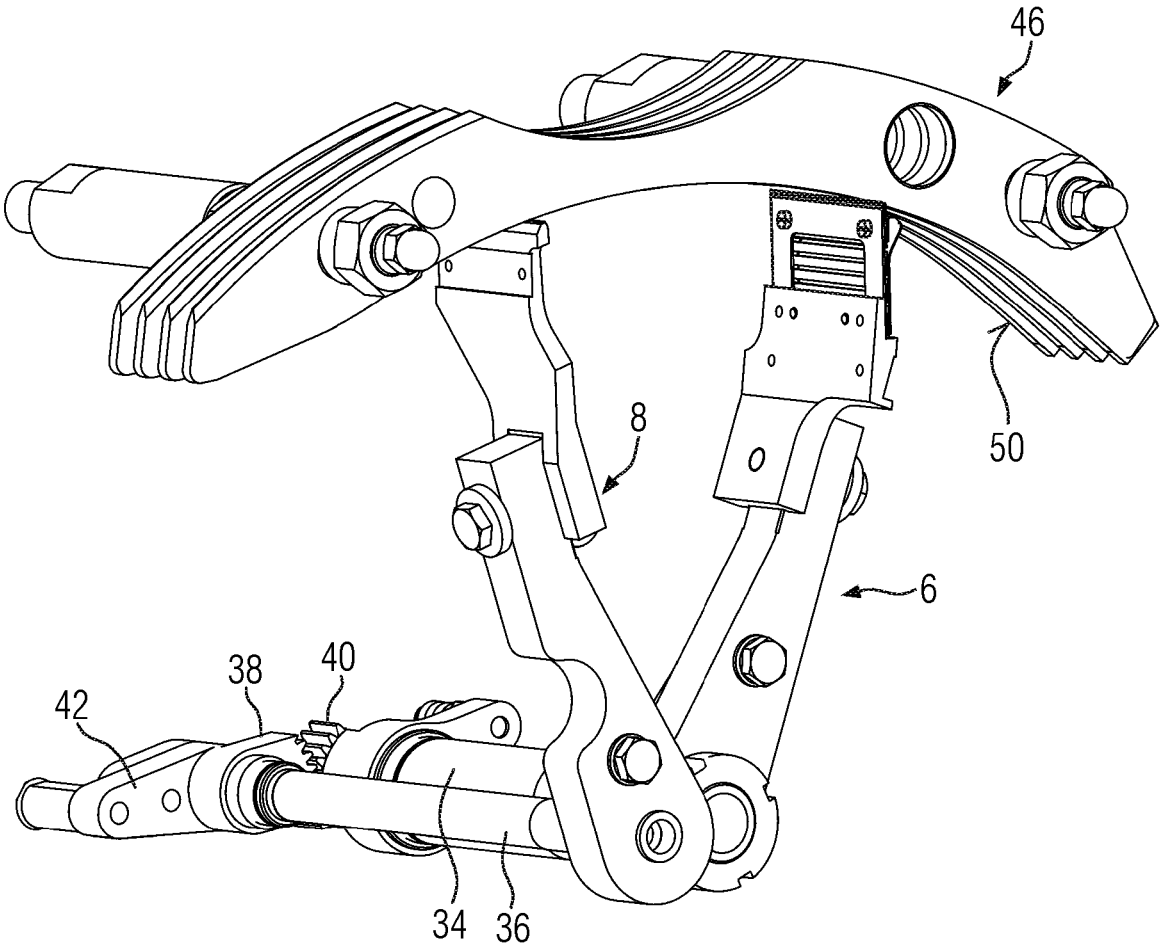
FIG. 3 is a perspective side view of a double-chamber bag forming set with the associated drive elements.

As can be seen from FIG. 3, one end of the lever arm 26 is swivelably guided in a curved path 32, which, during the continuous rotation of the transport wheel 2, forces the lever arm 26 in a movement path, which leads to a fixed translatory movement of the profile part 10 due to the articulated connection to the holding plate 28. This movement is a radial movement with respect to the axis of rotation 12 of the transport wheel 2.

As shown in FIGS. 2 and 3, one of the arms, in this case the leading arm 6, is firmly connected to a hollow shaft 34, in which a drive shaft 36, not shown in FIG. 2, of the other arm, in this case the trailing arm, is received. At the drive end of the drive shaft 36 there is a toothed segment 38 which meshes with a toothed segment 40 that is connected to the hollow shaft 34 in a torsionally rigid or non-twistable manner. In this way, the swivelling movements of the two arms 6, 8 are positively or forcedly coupled. A drive lever 42 is non-twistably or rotationally fixedly connected to the drive shaft 36 and is guided in a further cam track 44. The two cam tracks 32, 44 are formed by a cam plate 45, relative to which the transport wheel 2 rotates, so that the arms 6, 8 mounted by the transport wheel 2 and carried along with the rotation of the transport wheel and their shafts 34, 36 swivel relative to one another in a manner predetermined by the cam track 44; the same applies to the radial movement of the profile part 10.

FIG. 3 shows a cover 46 formed by a plurality of identically shaped discs, between which slots are formed for engagement of a hold-down device described in DE 38 06 386 C1. This hold-down device, which is not shown here, applies pressure in a radially inward direction to the central section of a cut-off piece of tube, which, laterally to this center, receives a respective portion of brewable material. Each of these sections forms the chambers of the double-chamber bag. For engagement of this hold-down device, the cover 46 has an indentation 48 on its radially outer surface. The opposite inner surface of the cover facing the axis of rotation 12 forms a concave contact surface marked with reference sign 50. This surface is essentially uniformly curved. Opposite to the direction of rotation, the contact surface 50 is formed with a substantially straight-extending inlet ramp 52, which merges into the concave contact surface 50 without a shoulder.

Apart from these details, the embodiment corresponds essentially to the embodiment described in DE 195 32 816 B4 or DE 38 06 386 C1.

In the embodiment shown, the concave contact surface 50 is arranged eccentrically to the axis of rotation 12 of the transport wheel 2. A radius indicated by reference sign R1 at the front end of the concave contact surface 50, i.e. at the transition between the inlet ramp 52 and the contact surface 50, is greater than a radius R2 at the rear end of the contact surface 50.

The mode of operation of the embodiment is explained below with reference to FIGS. 1*a* to 1*e*. In FIG. 1*a*, the trailing arm 8 of the trailing double-chamber bag forming set 4.2 is located in the region of the largest radius R1. Accordingly, the trailing arm 8 just touches the concave contact surface 50. The leading arm 8 of the corresponding forming set 4.2 is located approximately in the center of the contact surface 50. A piece of tube indicated by reference sign 54 is accommodated between the free ends of the arms 6, 8, respectively of the plates 16, 18 and the contact surface 50, wherein the piece of tube 54 does not contain any tea material in the center as brewable material, but contains tea portions on both sides of the center, with the tea portions being indicated by reference sign 56. Said center of the piece of tube 54 is indicated by reference sign 58.

In FIG. 1, the arms 6, 8 of the trailing forming set 4.2 are spread to the maximum. With increasing rotation and due to the specifications of the cam 45, the arms 6, 8 are swivelled towards each other, while the center 58 is supported by the profile part 10. At the height level of the indentation 48, the previously described hold-down device engages in the indentation and forces the material forming the bag in its center 58 between the clamping rollers 30. Thus, the piece of tube 54 is fixed centrally and frictionally to the profile part 10. This situation is shown in FIG. 1*b*. With continuous rotation of the transport wheel 2 (in FIGS. 1*a* to 1*e* clockwise), the arms 6, 8 are swivelled further toward each other, as is known in principle from the previously mentioned prior art. Thereby, the end portions of the piece of tube 54 clamped by the arms against the contact surface 50 are moved towards each other. As a result, the chambers of the piece of tube 54 formed between the center 58 and the ends are moved radially inwardly. Meanwhile, the profile part 10 is lowered radially inwardly along the guide 20, as is also known from DE 38 06 386 C1 or DE 195 32 816 B4. This lowering movement is illustrated in particular by comparing FIG. 1*b* with FIGS. 1*c* and 1*d*. It is evident that on the path of the forming set 4 in the direction of the rear end of the contact surface, the free ends of the arms 6, 8 are guided further towards each other until the piece of tube is fixed by clamping in the vicinity of the free ends.

Figure 1C:
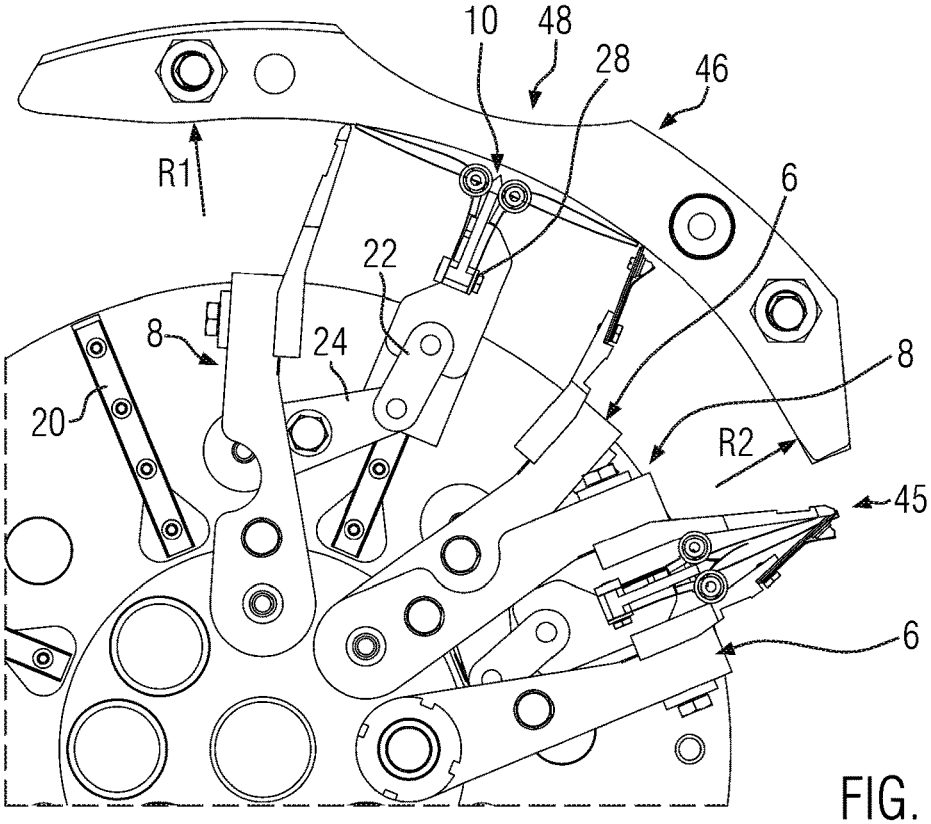
Figure 1D:
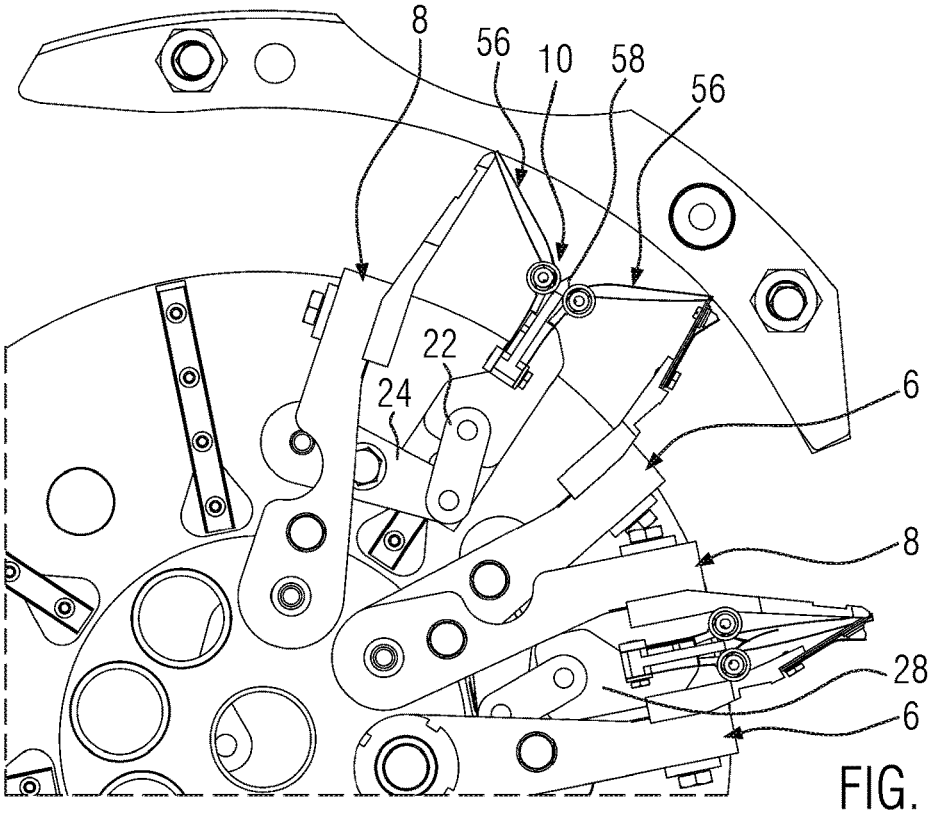
Figure 1E:
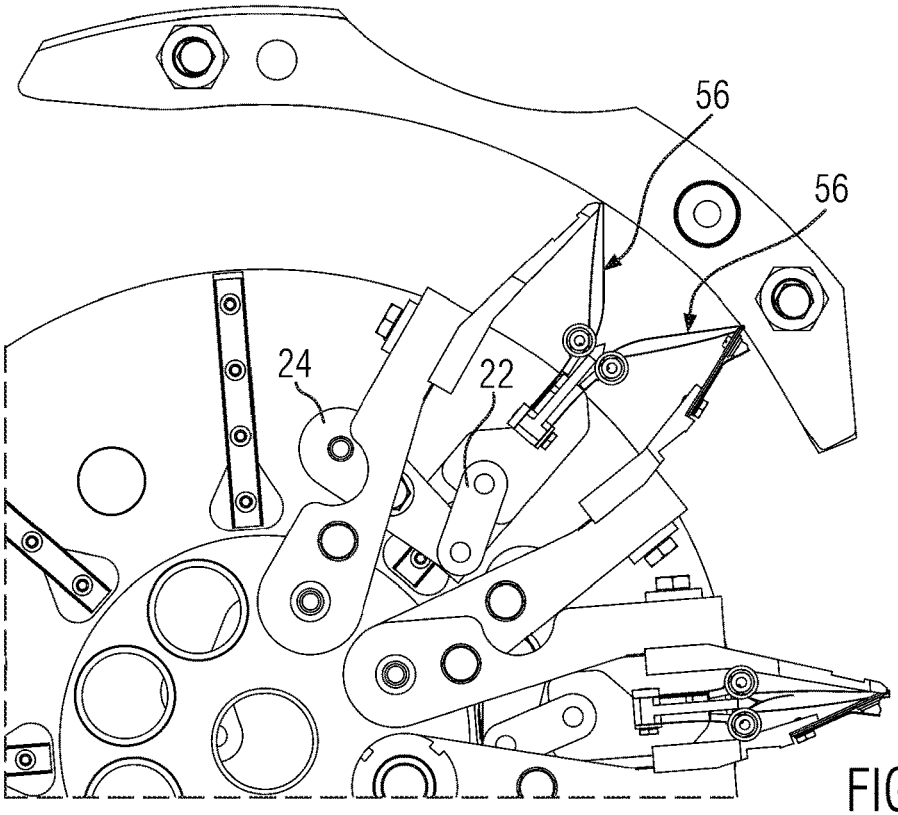
Figure 2:
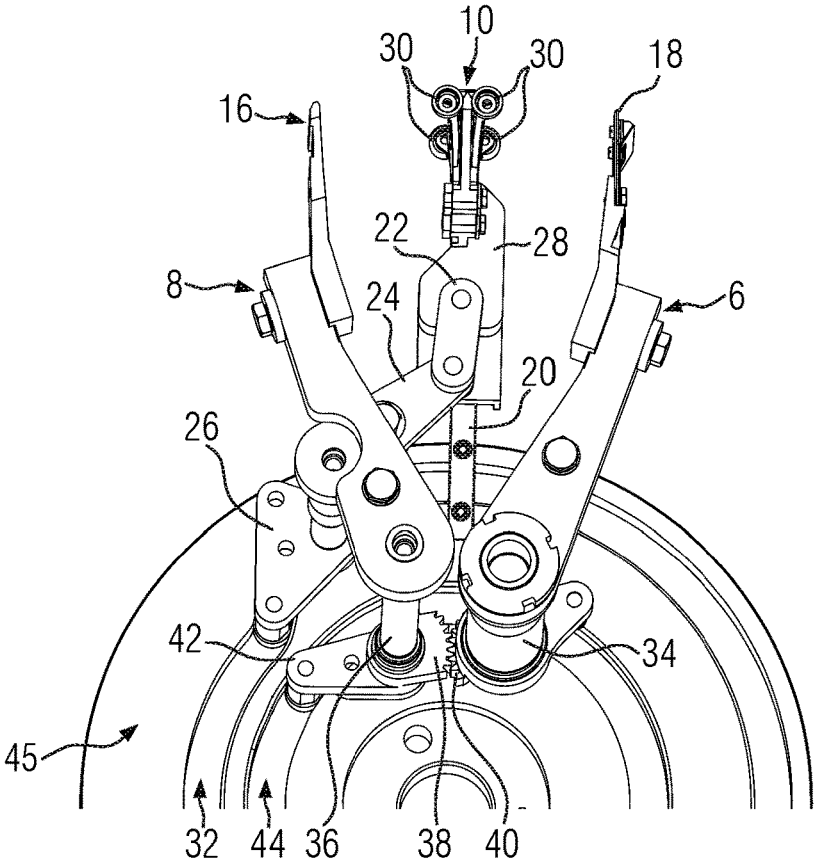
FIG. 2 is a perspective side view of the arms with their associated drive shafts and the cover of the embodiment.

Hereby, the arms 6, 8 of the leading forming set 4.1 have already left the contact surface 50 between FIG. 1*c* and FIG. 1*d* and now clamp the end portions of the piece of tube 54 against each other, so that the piece of tube 54 is held in this way between the free ends of the arms 6, 8. In this way, the profile part 10 can release the center 58 of the piece of tube 54 in the course of a further radial lowering in the direction of the axis of rotation 12. The double-chamber bag formed in this way is further processed in a further station approximately in accordance with the lower position of the leading forming set 4.1.

The eccentric mounting of the contact surface 50 and the reduction of the radius in the direction of the rear portion of the contact surface 50 in any case promotes the swivelling movement of the leading arm 8 in the direction of the profile part 10.

LIST OF REFERENCE SIGNS

2 Transport wheel
4 Double-chamber bag forming set
6 Leading arm
8 Tailing arm
10 Profile part
12 Axis of rotation
14 Swivel axis
16 Plate
18 Plate
20 Guide rail
22 Lever arm
24 Lever arm
26 Lever arm
28 Holding plate
30 Clamping roller
32 Cam track
34 Hollow shaft
36 Drive shaft
38 Toothed segment
40 Toothed segment
42 Drive lever
44 Cam track
45 Cam plate
46 Cover
48 Indentation
50 Contact surface
52 Inlet ramp
54 Piece of tube
56 Tea portion
58 Center of piece of tube
R1 Radius of front end of contact surface 50
R2 Radius of rear end of contact surface 50

The invention claimed is:

1. Device for transporting ready-cut and filled pieces of tube within a machine for producing double-chamber bags filled with brewable material comprising:

a transport wheel, which has distributed over a circumference of the transport wheel a plurality of double-chamber bag forming sets comprising:

a leading arm, a trailing arm and a radially movable profile part provided therebetween and configured to support a bottom of a double-chamber bag, and which is rotatably mounted under a cover arranged in a vicinity of an upper vertex of the transport wheel, wherein the leading and trailing arms are swivelably mounted eccentrically with respect to an axis of rotation of the transport wheel, and in that the trailing arm of a first double-chamber bag forming set, of the plurality of double-chamber bag forming sets, and the leading arm of an adjacent double-chamber bag forming set, of the plurality of double-chamber bag forming sets, are swivelably mounted along a common swivel axis.

2. The device according to claim 1, wherein one of the leading or trailing arms of one of the double-chamber bag forming sets is driven in a swivelling manner by means of a cam track and the other of the leading or trailing arms of the double-chamber bag forming set is driven in a swivelling and forcedly coupled manner via a toothing with the one of the leading or trailing arms.

3. The device according to claim 1, wherein one of the leading or trailing arms of one of the double-chamber bag forming sets is connected in a rotationally fixed manner to a hollow shaft, in which a drive shaft of an arm of the adjacent double-chamber bag forming set is received.

4. The device according to claim 1, wherein a concave contact surface of the cover is arranged eccentrically with respect to the axis of rotation of the transport wheel, and in that a radial distance of the concave contact surface from the axis of rotation of the transport wheel is greater in a front portion of the concave contact surface than in a rear portion of the concave contact surface.

* * * * *